United States Patent [19]

Perry

[11] 4,224,741

[45] Sep. 30, 1980

[54] BOW SIGHT

[76] Inventor: Frank W. Perry, 2608 S. 61 St., Philadelphia, Pa. 19142

[21] Appl. No.: 24,493

[22] Filed: Mar. 27, 1979

[51] Int. Cl.[3] ..... F41G 1/00

[52] U.S. Cl. ..... 33/265

[58] Field of Search ..... 33/265

[56] References Cited

U.S. PATENT DOCUMENTS

| | | | |
|---|---|---|---|
| 2,667,692 | 2/1954 | Leafstrand | 33/265 |
| 3,013,336 | 12/1961 | Pennington | 33/265 |
| 3,271,863 | 9/1966 | Harrington | 33/265 |
| 3,521,362 | 7/1970 | Duplechin | 33/265 |
| 3,568,323 | 3/1971 | Lendway | 33/265 |
| 3,718,979 | 3/1973 | Allen | 33/265 |
| 4,120,096 | 10/1978 | Keller | 33/265 |

FOREIGN PATENT DOCUMENTS

| | | | |
|---|---|---|---|
| 1914783 | 9/1970 | Fed. Rep. of Germany | 33/265 |

*Primary Examiner*—William D. Martin, Jr.
*Attorney, Agent, or Firm*—Steele, Gould & Fried

[57] ABSTRACT

A bow sight to be used in combination with an archer's bow comprising: a mounting bracket including means to mount said bracket to the bow; an arm rotatably mounted to said bracket so as to rotate over a range of positions; a sighting bead secured on the rotatable end of said arm; means to control the rotation of said arm; and scale means on said mounting bracket adjacent the range of positions of said arm.

9 Claims, 5 Drawing Figures

BOW SIGHT

BACKGROUND OF THE INVENTION

The present invention relates to a bow sight for an archer's bow which can be calibrated by the archer to provide range control for the archer. Many different types of systems have been used by archers to enable them to compensate for changes in range during either target shooting or hunting.

One such general type of sighting aid is known generally as a multiple bead or multiple pin bow sight. Such bow sights include a plurality of sighting beads and during the calibration process the archer will generally determine which bead to view depending upon the distance which the arrow must travel.

Other bow sights have but one sighting bead or pin and various techniques are used to adjust the pin or sighting bead to a particular position which represents that elevation change which is nexessary to compensate for the distance which the arrow must travel. The present invention relates to a single pin type of bow sight as will be described fully herein.

An archer's accuracy is dependent in part upon his ability to calibrate the bow so that the proper trajectory for an arrow to be shot can be calculated.

SUMMARY OF THE INVENTION

Accordingly, it is an object of the subject invention to provide a bow sight which can be accurately calibrated by the archer.

It is a further object of the subject invention to provide a bow sight which can be accurately calibrated by the archer expeditiously with a minimum of trial practice shots.

It is still a further object of the subject invention to provide a bow sight which can be accurately calibrated but which bow sight is relatively simple in contruction yet is capable of being calibrated to such a degree as to ensure competetive accuracy.

It is but another object of the subject invention to provide a bow sight which although capable of being accurately calibrated in inexpensive to manufacture for those unable to afford sophisticated and highly technical bow sights.

It is yet another object of the subject invention to provide a bow sight which is highly individualized and can be used by archers or varying skills.

It is yet one more object of the subject invention to provide a bow sight which is not overly sophisticated so as to be of value to beginning archers as well as expert archers.

In accordance with the above objects the subject bow sight is to be secured to an archer's bow by means of a mounting bracket, between the bracket and the bow which also serves to provide a pivot location for a sighting arm which is rotatably mounted to the bracket. At the forward end of the sighting arm a single sighting bead extends perpendicularly from the sighting arm so as to be viewable in the "window" location of the bow being used.

The subject invention comtemplates the use of a scale which is actually established by the archer during the calibration process. Thus, either the bow sight is constructed with an impressionable portion or, adhesive or otherwise mountable stickers are used to provide a means by which the archer can mark locations for the scale which correspond to various range positions. The scale will include various yard or meter increments which can be marked or ticked off such as every five or ten yards or meters.

Once the calibration process is completed and the archer has markings for different ranges, the bow sight can be quickly adjusted to enable the bow to be used at any of the ranges for which calibration has been made.

The arm which carries the sighting bead is frictionally biased against a portion of the bow sight so as to be adjustable only by firm urging of the user. Once an arm is moved to the desired location it can be securely locked in position so that it cannot be accidentally jarred as for an example when an archer is moving through brush in quest of game.

DETAILED DESCRIPTION

Figure 1:
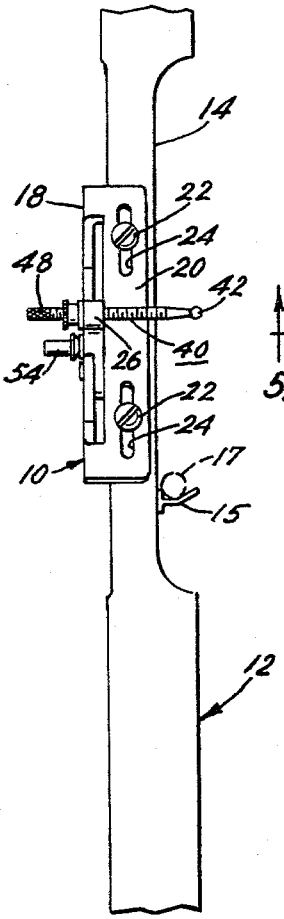
FIG. 1 is a front elevational view of a portion of a bow whereon the subject bow sight is mounted.

With reference to FIG. 1, the subject bow sight 10 is shown mounted on bow 12. The bow 12 may be a compound bow such as the BEAR bow which has received wide spread popularity. It should be noted, however, that use of the subject bow sight 10 is not restricted to any one particular type of bow and it may be used with many different types of styles. With further reference to FIG. 1, the bow 12 is shown having a window 14 to the side of where the bow sight 10 is mounted. Shown in the window 14 is an arrow test 15 with an arrow 17 shown in phantom. The window 14 is that portion of the bow where the archer looks when set to shoot as will be described more fully hereafter.

Figure 2:
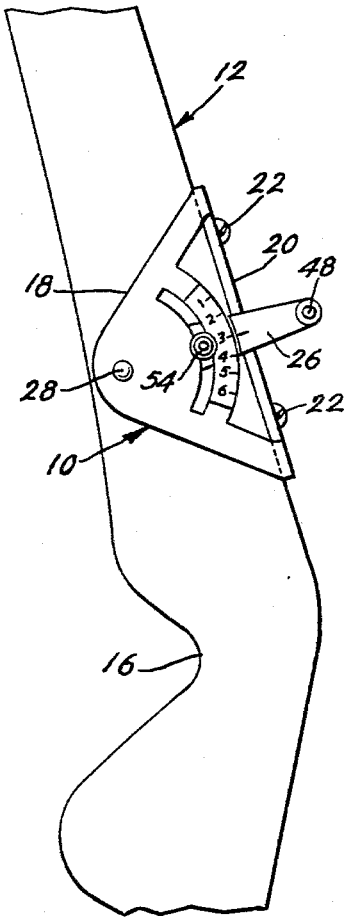
FIG. 2 is a side view of the portion of the bow of FIG. 1 showing the side view of the bow sight.

With reference to FIG. 2 and further reference to FIG. 1, the side view of the bow comprises a handle portion 16 where the archer physically grasps the bow with his one hand when shooting. It is noted that the bow sight 10 is mounted above this portion and corresponds with the usual area where the archer will be looking as through window 14 of FIG. 1. The bow sight 10 comprises a substantially triangular mounting member or bracket 18 which has its front portion 20 positioned at right angles to the remainder of the mounting member. The bow sight 10 is shown secured to the bow by screws 22 which extend through slots 24 as seen in FIG. 1. The slots 24 provide a range of positions so the bow sight 10 may be used thus requiring only one set of screw holes to be used in the bow. Accordingly, the bow sight 10 may be used on bow 12 with some variance in position to accomodate different archers or to permit readjustment as, for example, when arrow weight might change.

Figure 3:
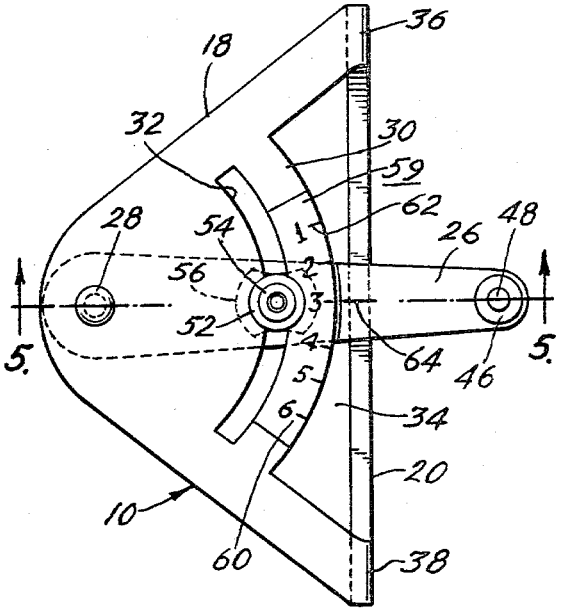
FIG. 3 is a detailed side elevational view of the bow sight removed from the bow.
Figure 4:
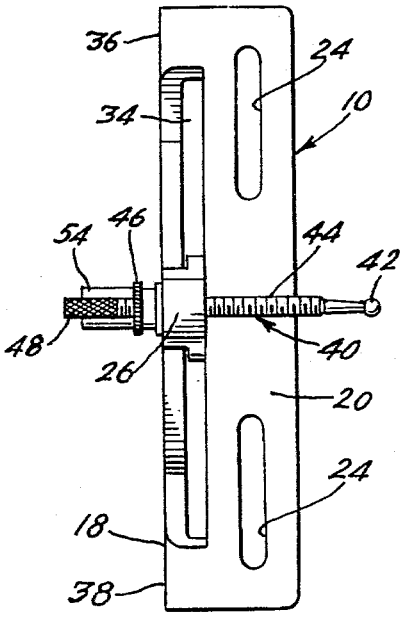
FIG. 4 is a detailed front elevation view of the bow sight of FIG. 3.

With reference now to FIGS. 3 and 4, the bow sight is shown in detail. The bow sight 10 is shown having a sighting arm 26 mounted to bracket 18, between the bracket and the bow 12 by means of a rivet type pivotal pin 28. The mounting bracket 18 includes a partial arc portion 30 and adjacent thereto arcuate space or slot 32. On the opposite side from the arcuate space or slot 32 of the arc portion 30 is opening 34 and it can be seen that the side face of mounting bracket 18 is connected to the front portion 20 only at the top and bottom of the bow sight 10. These areas are noted as corners 36, 38. As shown in FIGS. 1 and 2, the sighting arm 26 is disposed between the bracket 18 and the bow 12.

Figure 5:
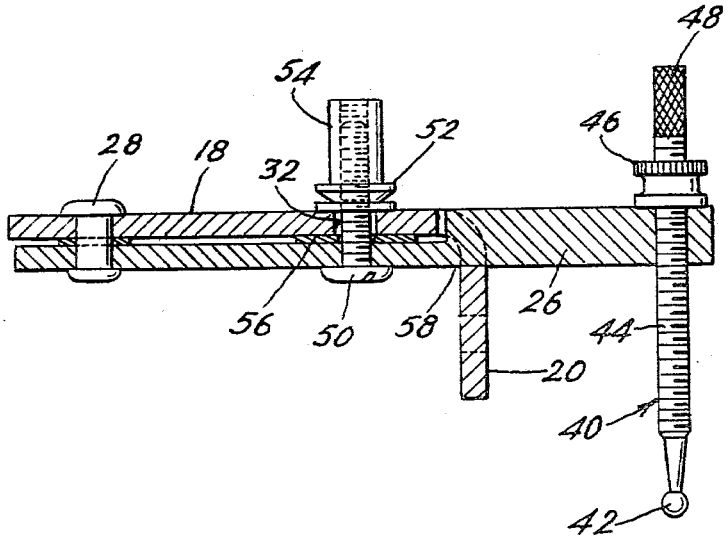
FIG. 5 is a cross-sectional view of the bow sight of FIG. 3 taken along the lines 5—5 of FIG. 3.

As best seen in FIG. 5, sighting member 40 comprises a sighting bead 42 which as shown in FIG. 1 appears in window 14. The sighting member 40 extends through a threaded hole in sighting arm 26 and is adjustable by means of threads 44 which are threadably engaged by locking nut 46. A knurled end 48 may be used to enable the user to turn sighting member 40 as it is desired to adjust the sighting bead 42.

With further reference to FIG. 5, a screw member 50 is permanently secured to sighting arm 26 and extends through the arcuate space or slot 32 of mounting bracket 18. A locking nut 52 with cover 54 is provided for screw 50. A spring 56 is shown in the space between bracket 18 and arm 26 which serves to bias the arm 26 against the corner 58 of front face portion 20 of the bow sight 10. Accordingly, the rotation of the arm 26 is not a free one as spring 55 serves to bias the sighting arm 26 against the front face 20 of the mounting bracket thus requiring firm urging by the user before the sighting arm can be moved. By use of locking nut 52 the sighting arm 26 can be locked firmly in place once a setting has been made to prevent sighting arm 26 from being jarred or otherwise moved.

With reference to FIG. 3 a scale 60 is shown on arc portion 30. As shown in FIG. 3, the scale has been printed on an adhesively attachable sticker 62. In an alternative embodiment, in lieu of the sticker 62 a roughened or otherwise impressionable surface can be created on arc portion 30 to enable scale ticks or marks to be made by the user directly on the frame during the calibration process. Sighting arm 26 is shown having a pointer 64 which can be adjusted to any of the scale settings during calibration.

The bow sight 10 can be conveniently made of aluminum or other similar light metal which can easily be fabricated or plastic which can be molded. The components such as screws, sighting members, nuts and the like can be constructed of any machinable metal.

The bow sight 10 is used in the following manner once it has been mounted on bow 12. Sighting arm 26 is set for an approximate short range setting. It is to be understood that the more sighting arm 26 is raised, the more the bow is tilted downward in use to cause the arrow's trajectory to be lower and the arrow to travel a shorter distance as the sight is raised. A fixed distance such as 10 yards is marked off and a group of arrows are shot to the target with the arm 26 being adjusted as necessary to bring the arrows right on target. Once this is achieved, if tape is being used for the marker then the tape 59 is placed on arc 30 to form a surface for scale 60 and a first mark or tick 62 is made to designate 10 yards such as the number 1. The desired range increment such as 10 or 20 yards is marked off and another group of arrows shot to establish how much lower sighting arm 26 need be moved to record the proper designation for the next range increment. As the sighting arm 26 and sighting pin 42 are moved lower and lower, the range increases since the bow leaves a vertical position with its top end being raised higher to create a higher arrow trajectory. Once the calibration process has been completed then the bow sight can be quickly set at the desired yardage and arrows shot at that distance.

It will be appreciated that the distance between tick marks will vary depending upon such things as the strength of archer, type of arrows, and the like. Accordingly, it is convenient for the archer to make his own scale during calibration rather than trying to adapt to a preexisting scale.

In lieu of the tape 62, the surface of the scale area of are portion 30 may be treated to be rough or otherwise impressionable such as having a matte surface so that marks can be made directly on the surface.

The present invention may be embodied in other specific forms without departing from the spirit or essential attributes thereof, and accordingly, reference would be made to the appended claims rather than to the foregoing specification as indicating the scope of the invention.

I claim:

1. A bow sight for use with an archer's bow, comprising:

a mounting bracket, having first and second portions, and including means for mounting said bracket to said bow;

an arm rotatably mounted to said first portion of said bracket, between said first portion and said bow, so as to be rotatable over a range of positions;

spring means, disposed between said arm and said first portion of said bracket, for biasing said arm against said second portion of said bracket;

hand adjustable locking means for locking said arm against rotation;

a sighting bead secured on the rotatable end of said arm; and, scale means on said bracket adjacent said arm and extending over said range of positions.

2. The bow sight of claim 1, wherein said first portion of said mounting bracket is substantially triangular in shape and said second portion is a perpendicular attachment portion securable to the front of said bow.

3. The bow sight of claim 2 wherein said rotatable arm is mounted to an apex region of said substantially triangular portion of said mounting bracket.

4. The bow sight of claim 1 wherein said sighting bead extends at a right angle from said arm and is viewable on the opposite side of the bow from said mounting bracket.

5. The bow sight of claim 2 wherein said substantially triangular portion includes a partial arc portion with an arcuate slot adjacent said partial arc portion and further includes an opening between said partial arc portion and said perpendicular attachment portion, said arm extending through said opening with a portion of said hand adjustable locking means extending through said arcuate slot.

6. The bow sight of claim 2 or 5 wherein said spring means biases said arm against an edge of said perpendicular attachment portion.

7. The bow sight of claim 5 wherein said arm includes a pointer and said scale means is disposed on said partial arc portion of said mounting bracket.

8. The bow sight of claim 1 wherein said scale means comprises a removable sticker.

9. The bow sight of claim 1 wherein said scale means comprises an impressionable surface on said mounting bracket.

* * * * *